US005708465A

United States Patent [19]

Morita et al.

[11] Patent Number: 5,708,465

[45] Date of Patent: Jan. 13, 1998

[54] THERMAL INK-JET HEAD

[75] Inventors: Naoki Morita; Jun Isozaki; Yoshihiko Fujimura; Masahiko Fujii, all of Kanagawa, Japan

[73] Assignee: Fuji Xerox Co., Ltd., Tokyo, Japan

[21] Appl. No.: 364,202

[22] Filed: Dec. 27, 1994

[30] Foreign Application Priority Data

Dec. 27, 1993 [JP] Japan ..... 5-353106
Dec. 27, 1993 [JP] Japan ..... 5-353107

[51] Int. Cl.[6] ..... B41J 2/05

[52] U.S. Cl. ..... 347/65; 347/92; 347/94

[58] Field of Search ..... 347/57, 63, 65, 347/85, 94, 92; 216/27

[56] References Cited

U.S. PATENT DOCUMENTS 5,041,844 8/1991 Deshpande ..... 347/65
5,068,006 11/1991 Fisher ..... 347/63

FOREIGN PATENT DOCUMENTS 61-230954 10/1986 Japan .
Hei. 1-148560 6/1989 Japan .
Hei. 5-124206 5/1993 Japan .
6-171092 6/1994 Japan .

*Primary Examiner*—N. Le
*Assistant Examiner*—L. Anderson
*Attorney, Agent, or Firm*—Finnegan, Henderson, Farabow, Garrett & Dunner, L.L.P.

[57] ABSTRACT

A thermal ink-jet head of the present invention is so designed as to improve operating frequency by surely trapping foreign substances and reducing the influence of a cross stroke. In the thermal ink-jet head of the present invention, a channel wafer is provided with a nozzle channel, a coupling flow channel, and an ink reservoir. A protective layer and a polyamide layer are formed on a heater wafer. The polyamide layer is provided with pits extending from a heating element up to the coupling flow channel and a bypass pit for coupling the ink reservoir and the coupling flow channel. Foreign substances are trapped at the entry port of the bypass pit and the entry port of the coupling flow channel. The pit controls the growth of the bubble by eating away the front end of the heating element and reducing its rear end. Moreover, the polyamide wall at the end of the pit is made semicircular to suppress the propagation of the pressure toward the coupling flow channel and to reduce the cross stroke by means of the coupling flow channel. The channel pressure wall at the end of the nozzle channel is used to reduce the flow channel resistance.

10 Claims, 9 Drawing Sheets

THERMAL INK-JET HEAD

BACKGROUND OF THE INVENTION

1. Field of the Invention

The present invention relates to a thermal ink-jet head which produces air bubbles in ink by using of heat generated by a resistive element for producing bubbles and jets the ink from nozzles by means of the air bubbles thus produced so as to execute recordings, and more specifically, relates to an ink flow channel structure in the thermal ink-jet head.

2. Description of the Related Art

For example, Unexamined Japanese Patent Publication No. Sho. 61-230954 discloses the flow channel structure of a known thermal ink-jet head which includes a first Si-substrate (heater substrate) and a second Si-substrate (channel substrate) in which a heating element is formed in the first Si-substrate, whereas nozzles and an ink reservoir are formed in the second Si-substrate by using ODE (anisotropic etching).

In the case of a thermal ink-jet head as disclosed in Unexamined Japanese Patent Publication No. Hei. 1-148560, the method of forming nozzles includes the steps of preparing a nozzle unit and an ink reservoir in the form of independent grooves to ensure that the length of each nozzle is made controllable, and coupling them via a recess (a bypass) provided in the polyamide layer of the first Si-substrate. The ink flow channel of the thermal ink-jet head thus formed tends to allow the impurities contained in ink to gather in the bypass because the bypass is narrow and curved. The problem in this case is that the nozzles are easily prevented from being supplied with ink. The foreign substances gathered in the bypass impair the supply of ink to the nozzles and deteriorates the repeat jet characteristics of the nozzles, thus making a jet drop smaller or otherwise rendering ink jet completely impossible. These malfunctions results in lowering image quality. On the other hand, it is extremely difficult to prevent such foreign substances from mixing with ink or slipping into the head during the process of manufacture; in other words, some foreign substances are unavoidably mixed therewith.

In order to prevent image quality from deteriorating because of foreign substance, for example, Unexamined Japanese Patent Publication No. Hei. 5-124206 has proposed to narrow an entry port of each individual ink flow channel so as to trap such foreign substances and provide a common ink flow channel to supply ink flow channel instead of relying on the ink flow channels clogged with foreign substances. Further, Unexamined Japanese Patent Publication No. Hei. 4-351842 has proposed to provide a common slit in a polyamide layer so as to supply ink from the common slit when foreign substances gather in a bypass.

Moreover, in order to surely trap foreign substances, for example, Japanese Patent Application No. Hei. 5-246419 discloses an arrangement which includes the steps of disposing a plurality of ink flow channels between the ink reservoir of a channel substrate and individual nozzle channels, and using not only a common slit provided in a polyamide layer to couple the individual nozzle channels with the ink flow channel but also a bypass provided in the polyamide layer likewise to couple the ink flow channel and the ink reservoir together. A thermal ink-jet head of this type ensures that foreign substances are trapped at the entry port of the nozzle channel together with the bypass. Even if foreign substances gather in this entry port, no deterioration in jet characteristics occurs since ink is supplied from the common slit.

However, in this type, since the whole length of the channel is lengthened because of having the ink flow channel, the resistance of the flow channel is increased, thereby lowering the filling efficiency. In other words, the frequency is ultimately lowered when printing is carried out. Similarly, it results in making the head costly that the flow Channel is lengthened. Consequently, the longer the flow channel, the greater the length of the Si-device necessary for forming the nozzles becomes and this also results in decreasing the number of Si-devices available from one sheet of Si wafer. An increase in the length of such a flow channel would cause the production cost per device on the assumption that the yield rate remains invariable.

Subsequently, Japanese Patent Application No. Hei. 5-269899 has proposed an arrangement in which a polyamide wall is dispensed so that a recess in a bubble generating resistive element is coupled to a common slit. With this arrangement, a flow channel can be shortened to the extent of the wall used to separate the recess in the bubble generating resistive element from the common slit and besides ink can smoothly be transferred onto the bubble generating resistive element. While the ability of trapping foreign substances in a bypass and the entry port of a nozzle channel is maintained, the flow channel resistance is thus reduced, whereby high-speed, stable ink-jetting can be performed.

Notwithstanding, the arrangement disclosed in Japanese Patent Application No. Hei. 5-269899 has presented a new problem in that a nozzle-to-nozzle cross stroke is produced. FIG. 8 illustrates a cross stroke phenomenon in a conventional thermal ink-jet head and FIG. 9 is a graphic representation depicting printing frequencies and the number of defective image quality in a solid printing unit. In FIG. 8, reference numeral 21 denotes nozzle channels; and 22, a common slit. FIG. 8 shows a recess ranging from a bubble generating resistive element to a common slit and nozzle channels formed in a channel substrate on the same plane; there are shown three nozzle channels #1, 2, 3. When a signal is applied to the bubble generating resistive element of the nozzle channels #1 and 3, ink jets are being sent out of the nozzle channels #1, 3. Although no printing signal is applied to the nozzle channel #2 at this time, the nozzle channel #2 is sending small ink drops. As a result, an unintended dot appears on paper, thus deteriorating image quality and this is because the bubble pressure applied to the adjoining nozzle channels #1, 3 is transmitted via the common slit 22 to the nozzle channel #2 as shown by arrows in FIG. 8. This phenomenon does not occur when ink jets are sent out of the whole nozzle channel but occurs in the case of an every-other-dot pattern. For this reason, any frequency liable to causing defects is improved in the solid printing unit as shown by solid lines, in comparison with an ordinary head as shown by dotted lines therein. Nevertheless, defective image quality has become conspicuous in the every-other-dot pattern.

With the arrangement above, the bubble pressure generated on the bubble generating resistive element is directly transmitted to the wall surface of the groove in the polyamide layer. Since the common slit is provided along the wall surface of the groove, the bubble pressure is directly propagated to the common slit. The cross stroke is considered as what has been produced accordingly.

On the other hand, Unexamined Japanese Patent Publication No. Hei. 5-116303, for example, discloses an ink-jet recording head so designed that the bubble pressure generated on a bubble generating resistive element is prevented from being transmitted to the rear of an ink flow channel. In this recording head, a flow channel in the rear of the bubble generating resistive element is narrowed. With this arrangement, since the bubble pressure generated on the bubble generating resistive element is blocked in the narrow portion of the flow channel, the propagation of the pressure in the rear of the bubble generating resistive element is reduced. However, no consideration has been given to the effect of foreign substances in the patent publication above. Since the whole flow channel section is directly regulated by planar throttling in this thermal ink-jet head, moreover, the flow channel resistance will increase if the flow channel is excessively narrowed, thus deteriorating the frequency response characteristic of the ink jet.

SUMMARY OF THE INVENTION

In view of the foregoing problems, it is an object of the present invention to provide a thermal ink-jet head so designed as to improve operating frequency by surely trapping foreign substances and reducing the influence of a cross stroke.

A thermal ink-jet head of the present invention is comprised Of a heater substrate having bubble generating resistive elements; a channel substrate having a plurality of nozzle channels, an ink reservoir, and ink supplying opening, the nozzle channels being formed in the channel substrate to pass on the bubble generating resistive elements and extends up to a position close to an end portions of the bubble generating resistive elements; a coupling flow channel for communicating with each nozzle channel, which is provided between the plurality of nozzle channels and the ink reservoir on the channel substrate; and a synthetic resin layer provided on the heater substrate, the synthetic resin layer having a groove which at least extending from an upper part of the bubble generating element up to a position where the groove is coupled to the flow channel formed in the channel substrate.

According to the present invention, the nozzle channel formed in the channel substrate is passed on the bubble generating resistive element and extended up to the rear end of the bubble generating resistive element and the flow channel is provided in such a way as to communicate with each nozzle channel between the plurality of nozzle channels of the channel substrate and the ink reservoir, and further the recess provided in the synthetic resin layer is extended from the upper part of the bubble generating resistive element up to the position where it is coupled to the flow channel with the effect of decreasing the whole length of the nozzle. Moreover, foreign substances are trapped at the entry port of the nozzle channel and defective image quality can be reduced by supplying ink in a roundabout way to any portion where the flow of ink is obstructed because of foreign substances with which the flow channel is clogged. Further, the channel substrate is provided with the flow channel and the ink flow channel is curved toward the groove in the synthetic resin layer from the flow channel and further curved to reach the upper part of the bubble generating resistive element, so that the bubble pressure generated in the bubble generating resistive element is prevented from directly propagating through the adjoining nozzle channels via the flow channel. The cross stroke can thus be reduced.

BRIEF DESCRIPTION OF THE DRAWINGS

In the accompanying drawings.

THE PREFERRED EMBODIMENTS OF THE INVENTION

The preferred embodiments of the present invention will be described referring to the accompanying drawings as follows.

Figure 1:
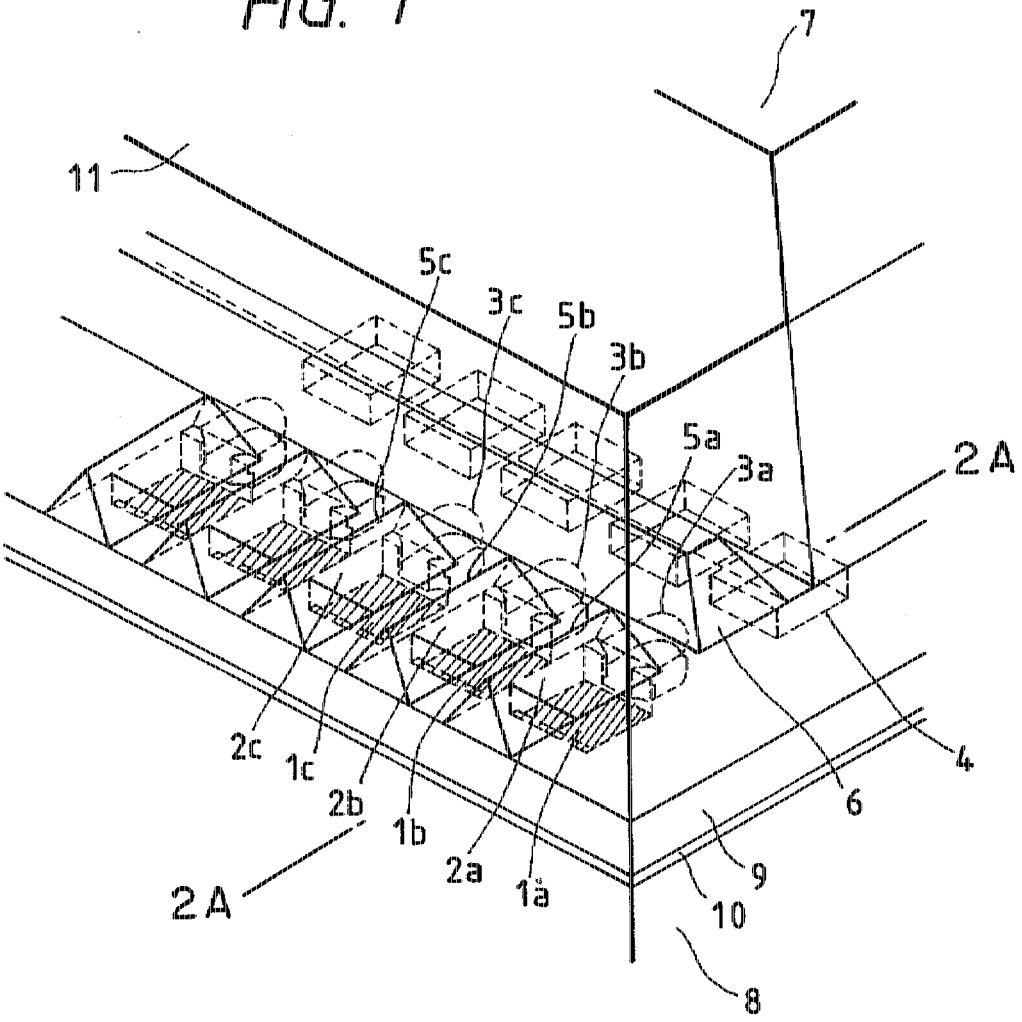
FIG. 1 is a schematic perspective view of a thermal ink-jet head of a first embodiment of the present invention.
Figure 2B:
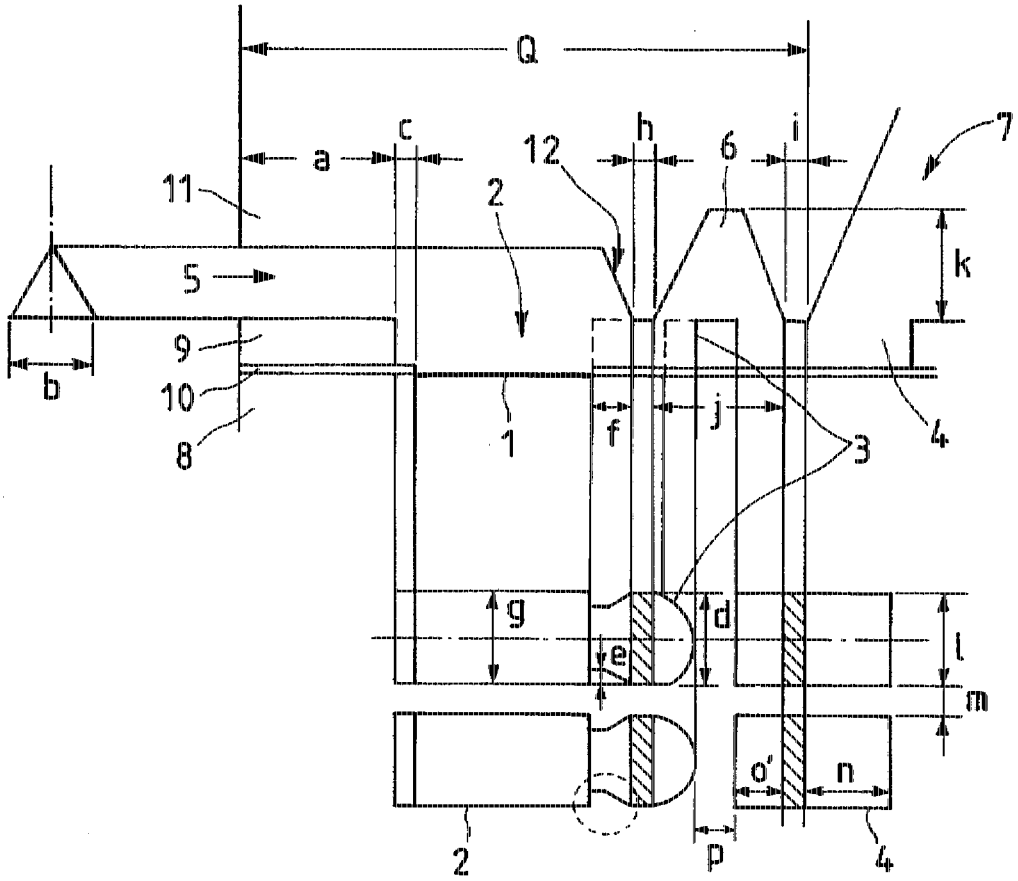
FIG. 2B is a three-side diagram of a flow channel in the thermal ink-jet head of the first embodiment.
Figure 3:
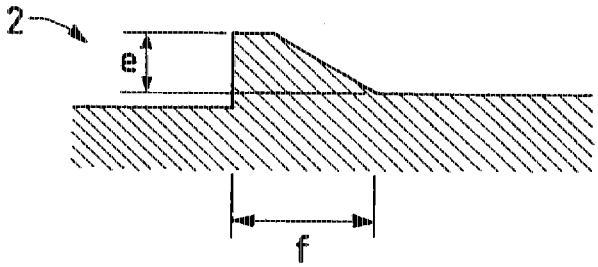
FIG. 3 is a partial enlarged view of a pit in the thermal ink-jet head of the second embodiment.
Figure 4:
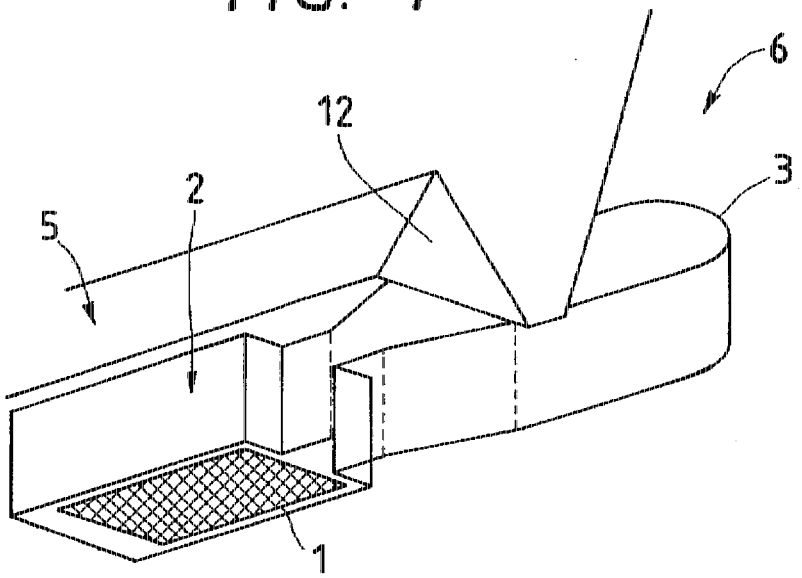
FIG. 4 is an enlarged perspective view of the vicinity of a pit in the thermal ink-jet head of the first embodiment.

FIG. 1 is a schematic perspective view of a thermal ink-jet head of a first embodiment of the present invention. FIG. 2B is a diagram illustrating three sides of the flow channel structure. FIG. 3 is a partial enlarged view of a pit. FIG. 4 is an enlarged perspective view of a portion near a pit. In these drawings, reference numerals 1, 1*a*, 1*b*, 1*c* designate heating elements; 2, 2*a*, 2*b*, 2*c*, pits; 3, 3*a*, 3*b*, 3*c*, polyamide walls; 4, a bypass pit; 5, 5*a*, 5*b*, 5*c*, nozzle channels; 6, a coupling flow channel; 7, an ink reservoir; 8, a heater wafer; 9, a polyamide layer; 10, a protective layer; 11 a channel wafer; and 12, a channel pressure wall. FIG. 3 is an enlarged view of the inside of a circle with a dotted line.

The thermal ink-jet head includes the channel wafer 11 and the heater wafer 8 on which the polyamide layer 9 is formed, these wafers being bonded together. The heater wafer 8 is made of Si, for example, and contains a plurality of heating elements 1*a*, 1*b*, 1*c*, . . . , common and individual electrodes (not shown) and the like. The protective layer 10 for protecting the electrodes is formed on the heater wafer 8 and, further, the polyamide layer 9 is formed thereon. Pits 2*a*, 2*b*, 2*c*, . . . coupled to a coupling flow channel 6 from the upper parts of the heating elements 1*a*, 1*b*, 1*c*, . . . and the bypass pit 4 for coupling the ink reservoir 7 with the coupling flow channel 6 are formed as grooves in the polyamide layer 9 by etching or the like. On the other hand, the channel wafer 11 is also made of Si, and the nozzle channel 5*a*, 5*b*, 5*c*, . . . , the coupling flow channel 6 and the ink reservoir 7 are formed thereon by ODE, for example.

The pit 2 slightly eats away the polyamide layer 9 in front of the heating element 1 as shown in FIG. 2B. Moreover, the pit 2 is configured so that it throttles the flow channel in terms of a plane in the rear portion of the heating element 1. Such a configuration can easily be attained by designing a mask pattern on the polyamide layer 9 in conformity with the configuration of the pit 2. A position where the pit is placed is gradually narrowed toward the heating element 1 from the smallest blockage of the flow channel due to the channel pressure wall 12 and minimized in terms of a plane right behind the heating element 1.

Figure 5A:
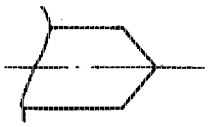
FIGS. 5A and 5B are partial enlarged views of an example of a design pattern of a polyamide mask.
Figure 5B:
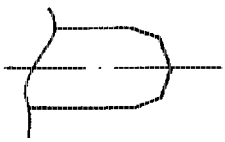

Further, the polyamide wall 3 formed at the joint between the pit 2 and the coupling flow channel 6 have a semicircular shape. Since the end of the extension of the pit 2 apparently functions as a pressure reflective wall against the bubble pressure generated in the heating element 1, a reduction in the cross stroke can be achieved by rendering the end portion thereof to have a nonlinear pressure-wave absorbing structure. In order to actually design the circular structure, a polygonal structure is to be employed for a polyamide mask pattern. FIGS. 5A and 5B illustrate partial enlarged design patterns of such a polyamide mask by way of example. As shown in FIG. 5A, the simplest mask pattern is triangular, which is followed by what is pentagonal as shown in FIG. 5B. Therefore, the mask pattern does not have to be completely semicircular and in this embodiment, an octadecagon (18-sided structure) has been employed. The actually resulting polyamide wall 3 becomes substantially semicircular due to the restriction of resolution.

On the other hand, a non-etching portion between the nozzle channel 5 and the coupling flow channel 6 is placed at the rear end of the throttled portion of the pit 2. Consequently, the tilted, or non-perpendicular channel pressure wall 12 is formed at the end of the nozzle channel 5 formed by ODE. As shown in FIG. 4, the channel pressure wall 12 is such that the flow channel can be expanded three-dimensionally in the throttled portion of the pit 2, thus increasing the total cross sectional area of the flow channel increases. Since the channel pressure wall 12 is substantially extended up to the end of the heating element 1, it functions as what controls the growth of the bubble produced on the heating element 1 and reflects the bubble pressure in the direction of an ink outlet.

The coupling flow channel 6 of the channel substrate 11 is extended in the nozzle orientating direction so as to couple a plurality of nozzles together. If one of the individual bypass pits 4 is clogged with foreign substances or fails to make ink flow smoothly therein, it is possible to supply ink from an adjoining bypass pit 4 via the coupling flow channel 6. The coupling flow channel 6 may be set common to the whole nozzle or otherwise provided for any one of the groups of nozzles. In the latter case, though the adjoining block-to-block cross stroke may be prevented, the supply of ink to the peripheral nozzles may be lower in quantity than what is supplied to those in the central part.

The coupling flow channel 6 thus functions as an ink pool; by this is meant that it has the effect of improving the supply of ink to the nozzles. Therefore, it is preferred for the coupling flow channel 6 to have a volume as great as possible. The size of the coupling flow channel 6 is determined under the restriction of chip size.

Further, the coupling flow channel 6 has the effect of attenuating the backward propagation of the bubble pressure generated on the heating element 1. In other words, the bubble pressure is caused to collide with the rear end of the pit 2 so that the pressure is turned upward, and further to collide with the sidewall and upper face of the coupling flow channel 6 so as to be turned its direction again. Consequently, the pressure applied to the ink reservoir 7 and the adjoining nozzles is attenuated with the effect of decreasing the cross stroke.

The bypass pit 4 is individually provided for each nozzle. However, the bypass pit 4 can be formed as a slit-like groove. Further, the bypass pit 4 can be constructed so that an underside of the not-etching portion between the ink reservoir 7 and the coupling flow channel 6 is for common use to make them individual openings.

Figure 2A:
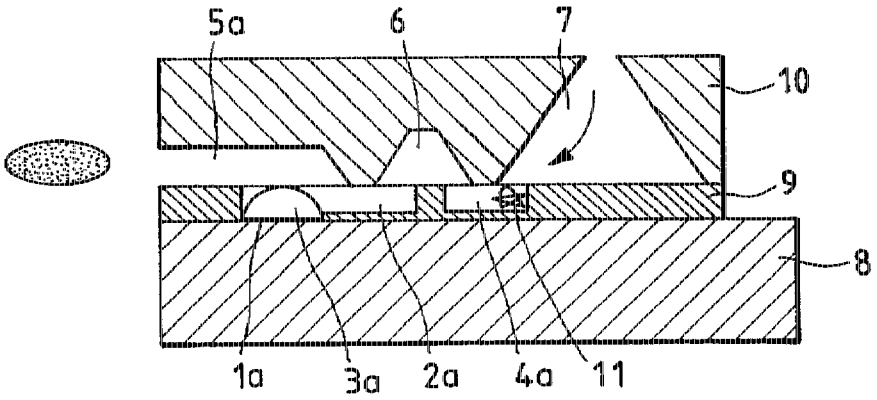
FIG. 2A is a sectional view of a flow channel in the thermal ink-jet head of the first embodiment.

As shown in FIG. 2A, ink flows from the ink reservoir 7 via the bypass pit 4 and the coupling flow channel 6 up to the pit 2 and nozzle channel 5. There is provided a filter in two places where foreign substances can be trapped. Large ones out of the foreign substances that have penetrated into the ink reservoir 7 are trapped at the entry port of the bypass pit 4. Although it is very rare for large foreign substances to pass through that portion, they are still trapped at the entry port of the coupling flow channel 6. As the foreign substances passing through the filter are extremely small in quantity, the nozzle channel 5 is seldom clogged therewith and the foreign substances together with ink are quickly jetted from the nozzle. Even when the foreign substances or bubbles are trapped at the entry port of the bypass pit 4 or the coupling flow channel 6 to cause the bypass pit 4 to be clogged therewith, ink can be supplied to any nozzle deficient in ink supplementary by supplying ink from an adjoining nozzle or what is in the neighborhood thereof via the coupling flow channel 6. It is thus possible to compensate for deficiency in the supply of ink to the extent that actual image quality is distinguishable.

The ink made to flow into the pit 2 is passed through the throttled portion of the pit 2 to be supplied onto the heating element 1. Although the flow channel in plane of this portion is narrow, the total sectional area of the flow channel is increased as it is widened three-dimensionally by the channel pressure wall 12 to prevent the flow channel resistance from increasing. Consequently, ink is supplied onto the heating element 1 via the throttled portion of the pit 2 and along the channel pressure wall 12 after the bubble is produced on the heating element 1 to ensure that the ink is smoothly refilled. The frequency response characteristic of the ink is never deteriorated.

Figure 6A:
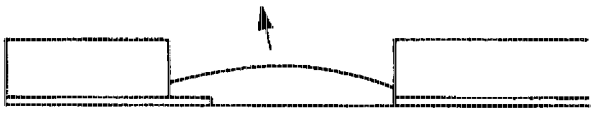
FIGS. 6A and 6B are illustrations of examples of forming bubbles.
Figure 6B:
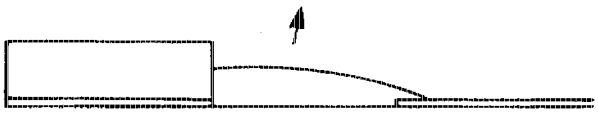

When the bubble is produced on the heating element 1, a good bubble can be formed in accordance with the configuration of the pit 2 around the heating element 1 as noted previously. FIGS. 6A and 6B illustrate processes of forming a bubble by way of example. In the case of such a conventional thermal ink-jet head as disclosed in Japanese Patent Application No. Hei. 5-269899, for example, pits 2*a*, 2*b*, 2*c* have been coupled directly to the common slit from above heating elements 1*a*, 1*b*, 1*c*. . . , respectively. In this case, the growth of the bubble is controlled by the wall of the forward pit, whereby the rear side of the heating element is free. Consequently, as shown in FIG. 6B, the bubble grows rearwardly and its pressure is allowed to escape rearwardly. In this embodiment, the front portion of the heating element is slightly removed and the rear side thereof is throttled so that the growth of the bubble is somehow orientated in the ink jetting direction as shown in FIG. 6A. Thus the bubble pressure is efficiently utilized, whereas the propagation of the pressure in the direction of the coupling flow channel 6 is reduced.

Referring to FIG. 2B, a detailed description will subsequently be given of a thermal ink-jet head of the present invention. The nozzle channels 5*a*, 5*b*, 5*c* may be disposed at a density of 300 spi, for example. Moreover, the length a of the nozzle in the polyamide layer 9 is approximately 115 μm and the width b of the channel layer is approximately 54 μm. The length c of the removed portion in front of the heating element 1 of the pit 2 is set at approximately 10 μm, for example. The width of the flow channel of the pit 2 right under the channel pressure wall 12 is about 54 μm; this is the narrowest portion having the dimensions defined by the width of polyamide opening and the thickness of polyamide, namely, 54×25 μm. The configuration of the polyamide wall of the pit 2 is made octadecagonal as mentioned above, which is close to semicircular.

The throttled portion of the pit 2 is prepared by reducing its one side e right under the channel pressure wall 12 by about 15 μm, 30 μm in total. In other words, the plane of the flow channel of the pit 2 is reduced to about 44% toward the heating element 1 from right under the channel pressure wall 12. The length f of the flow channel from the starting point of throttling up to the immediate end of the heating element 1 ranges from the starting point of throttling, that is, a starting position where the channel pressure wall 12 is formed up to the immediate end of the heating element to the immediate end of the heating element, which is about 30 μm. Further, the width g of the pit 2 in the portion of the heating element 1 is about 60 μm and with respect to the width of the pit 2 on the heating element side 1, the width of the throttled opening is reduced to 40%. The shortest length h of the non-etching portion between the nozzle channel 5 and the coupling flow channel 6 is about 15 μm, whereas the shortest length i of the non-etching portion between the coupling flow channel 6 and the ink reservoir 7 is set at about 10 μm.

With respect to the coupling flow channel 6, the bottom side j of a trapezoid in cross section thereof is set about 110 μm. A satisfactory effect can be obtained from the size mentioned above. Moreover, the height k of the coupling flow channel 6 is determined by the etching time of the channel plate, which is approximately 60 μm.

The sum of the width l of the opening of the bypass pit 4 which functions as a filter for trapping foreign substances and the thickness m of the adjoining partitions is 84.5 μm equivalent to a nozzle arranging pitch. The length n of the opening on the ink reservoir side 7 separated by a channel partition 21, that is, the length of a first filter is 60 μm, and the length o of the opening on the coupling flow channel side 6, that is, the length of a second filter is 44 μm. The shortest space p between the pit 2 and the bypass pit 4, that is, the length of the portion on the central line of the flow channel of FIG. 2B is 20 μm. The whole,length Q from the end of the nozzle up to the channel partition 21 is 410 μm.

Figure 7:
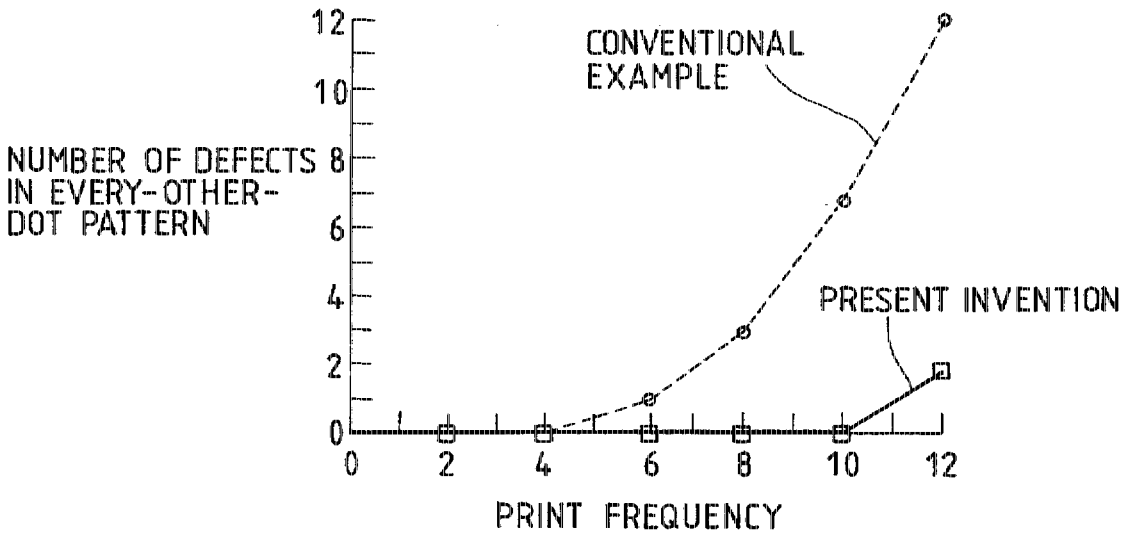
FIG. 7 is a graphic representation showing frequency response characteristics in the thermal ink-jet head of the first embodiment.
Figure 8:
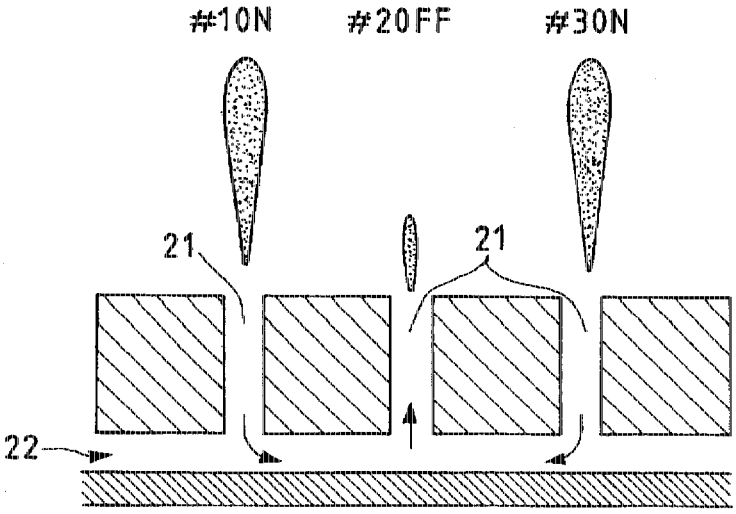
FIG. 8 is an illustration of a cross stroke in a conventional thermal ink-jet head.
Figure 9:
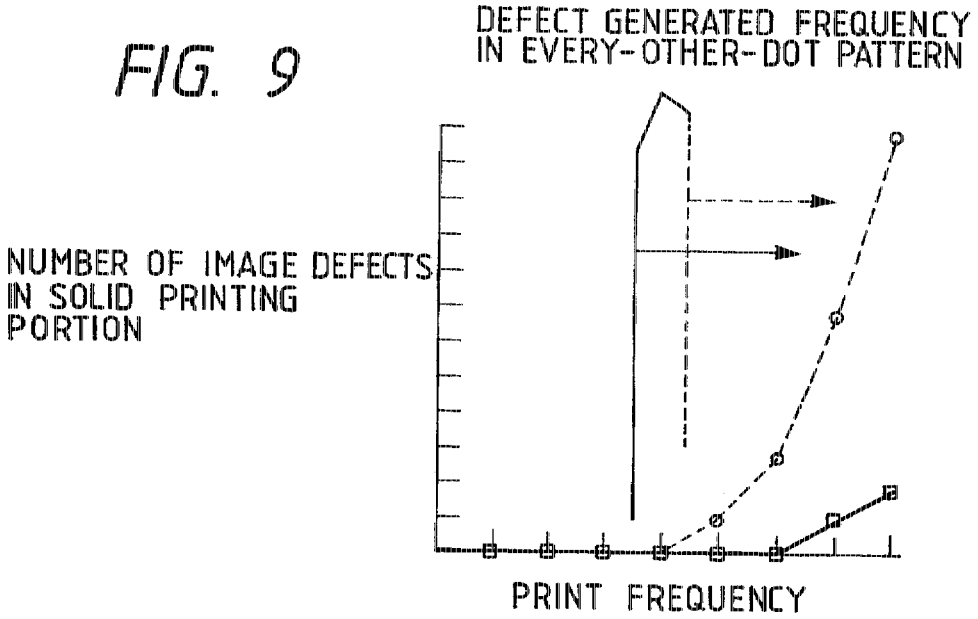
FIG. 9 is a graphic representation showing printing frequency and the number of image quality defects in solid printing.

FIG. 7 is a graphic representation illustrating frequency response characteristics in the thermal ink-jet head according to the present invention. In FIG. 7, there is shown a relation between printing frequency when an every-other-dot pattern is printed and the number of defects brought about. In the case of the conventional head, image quality has been affected seriously even by a low printing frequency when such an every-other-dot pattern is printed. However, as shown in FIG. 7, no defects are seen to result from a high printing frequency, which has heretofore caused defects very often, and desired image quality is maintained by the thermal ink-jet head according to the present invention. Therefore, it has become possible to greatly improve problematical defect-causing frequencies in half tone in any other conventional heads. More specifically, operations ranging from 10 to 12 kHz are practically performable without any difficulty. In other words, approximately 20 kHz is possible as printing frequency in a character mode as it does not require a flow rate so much in the case of solid or half tone.

As set forth above, according to the present invention, the flow channel structure functioning as what is capable of trapping foreign substances and the like prevents the nozzle from being clogged up and even when such foreign substances are trapped, the coupling flow channel is usable for supplying ink. Good image quality can thus be maintained. Moreover, the groove structure in the polyamide layer together with the coupling flow channel makes it possible to generate bubbles with stability and to suppress the propagation of the bubble pressure rearwardly. As the bubble pressure is effectively utilizable, the cross stroke is also reducible. Consequently, good image quality is obtainable even when an every-one-dot pattern is printed and operating frequencies are improved with the effect of making a high-speed printer available. Since the whole length of the flow channel is short, the device is reducible in size and this results in securing more substrates per wafer inexpensively.

Figure 10:
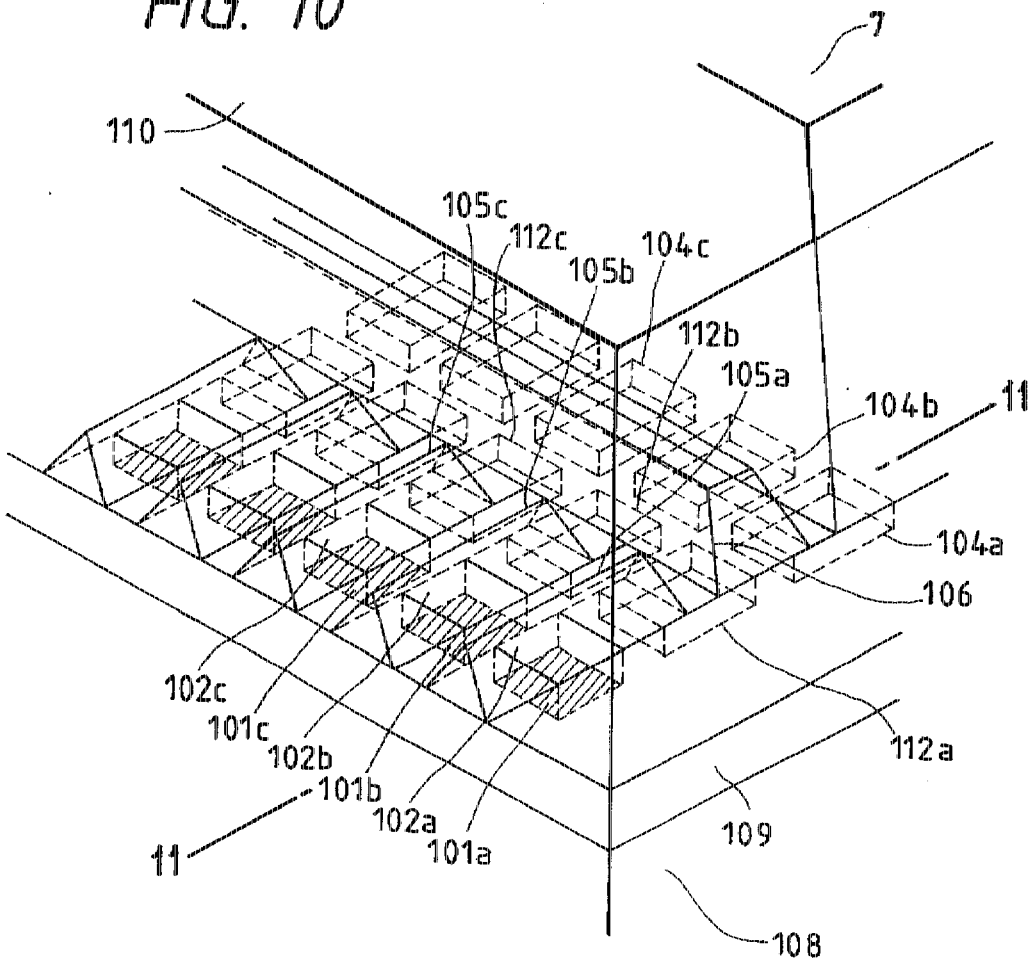
FIG. 10 is a schematic perspective view of a flow channel's structure of a thermal ink-jet head of a second embodiment of the present invention.
Figure 11:
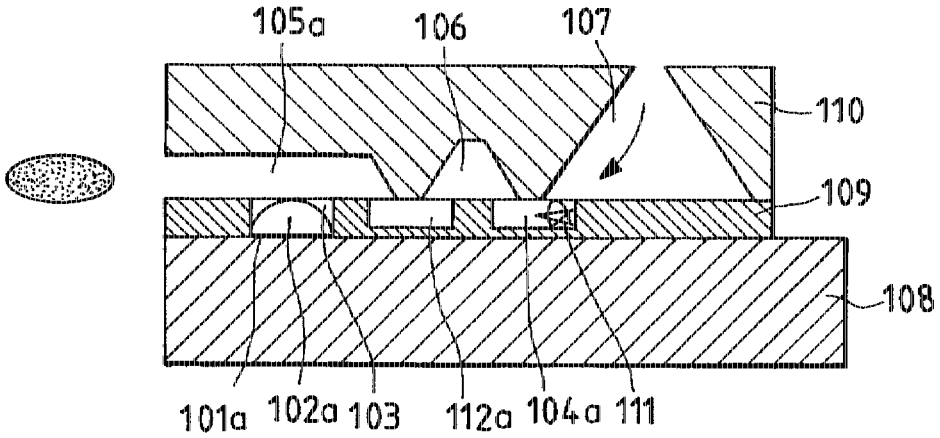
FIG. 11 is a sectional view showing the flow channel at the center of a nozzle in the thermal ink-jet head of the second embodiment.
Figure 12:
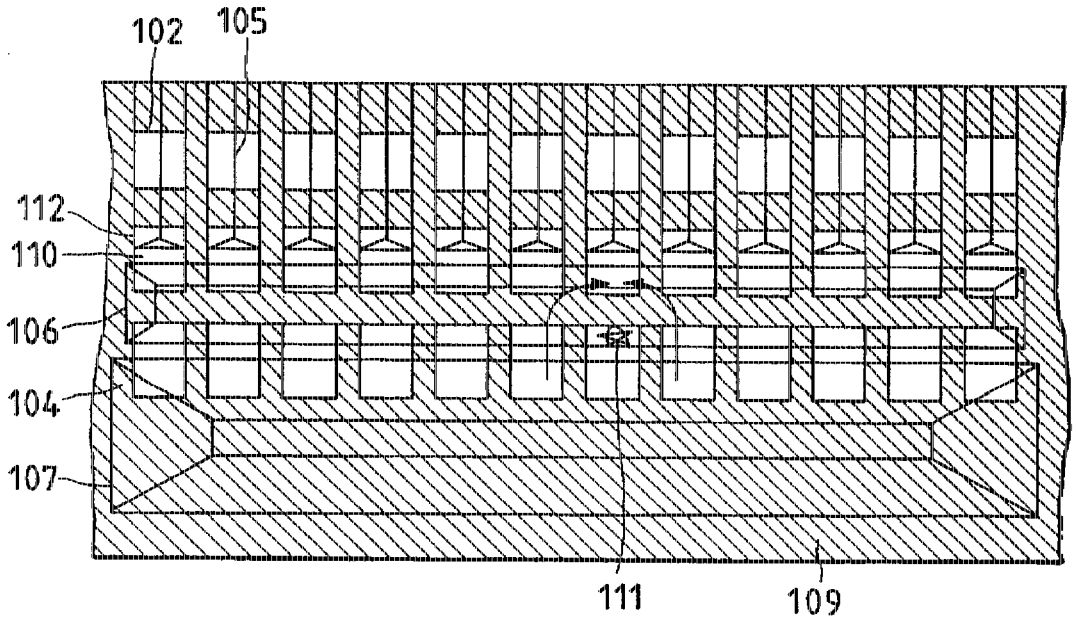
FIG. 12 is a plan view showing a structure of the flow channel in the thermal ink-jet head of the second embodiment.
Figure 13A:
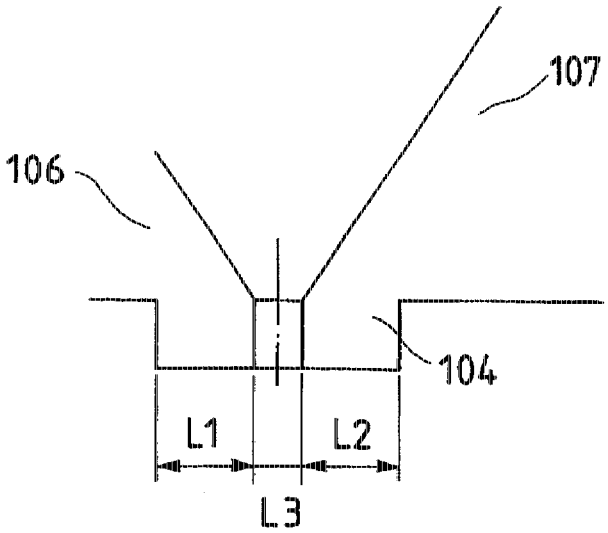
FIGS. 13A and 13B are partial enlarged views of the vicinity of a bypass pit in the thermal ink-jet head of the second embodiment.
Figure 13B:
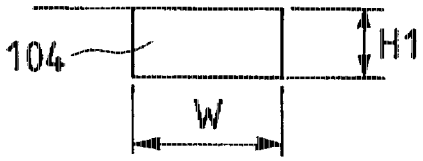
Figure 14:
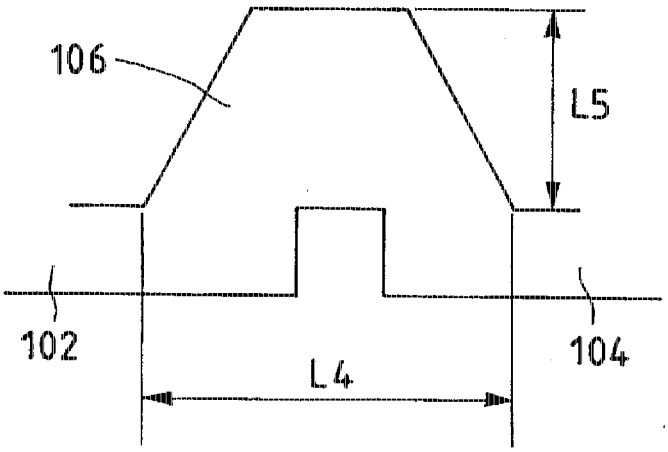
FIG. 14 is a partial enlarged view of the vicinity of a sub-reservoir in the thermal ink-jet head of the second embodiment.

FIG. 10 is a perspective view of a flow channel structure in a second embodiment of a thermal ink-jet head of the present invention. FIG. 11 is a sectional view of a flow channel in the center of a nozzle. FIG. 12 is a top view of the flow channel structure. FIG. 13 is a partial enlarged view of the vicinity of a bypass pit. FIG. 14 is a partial enlarged view of the vicinity of a sub-reservoir. Reference numerals 101, 101*a*, 101*b*, 101*c* denote heating elements; 102, 102*a*, 102*b*, 102*c* pits; 103, a bubble; 104, 104*a*, 104*b*, 104*c* bypass pits; 105, a nozzle channel; 106, a sub-reservoir; 111, foreign substance; and 112, 112*a*, 112*b*, 112*c* ink flow channels.

The thermal ink-jet head includes a channel wafer 110 and a heater wafer 108 on which a polyamide layer 109 is formed, these wafers being bonded together. The heater wafer 108 is made of Si, for example, and contains a plurality of heating elements 101*a*, 101*b*, 101*c*, . . . , common and individual electrodes (not shown) and the like. The polyamide layer 109 is formed on the combination of these wafers. Pits 102*a*, 102*b*, 102*c*, . . . for defining an area for forming the bubble 103 are formed on the heating elements 101*a*, 101*b*, 101*c*, . . . . Further, together with the pits, ink flow channels 112*a*, 112*b*, 112*c* for coupling nozzle channels 105*a*, 105*b*, 105*c* with the sub-reservoir 106, and bypass pits 104*a*, 104*b*, 104*c*, . . . for coupling the ink reservoir 107 and the sub-reservoir 106 are formed on the polyamide layer 109 by etching, for example. On the other hand, the channel wafer 110 is also made of Si, and the nozzle channels 105*a*, 105*b*, 105*c*, . . . , the sub-reservoir 106 and the ink reservoir 107 are formed by ODE, for example. The sub-reservoir 106 is extended in the orientating direction of the nozzles. One sub-reservoir common to the whole nozzle may be provided or otherwise provided for nozzles on a group basis.

Ink is made to flow from the ink reservoir 107 via the bypass pit 104 to the sub-reservoir 106 as shown in FIG. 11. The portion of the bypass pit 104 is curved and narrow in cross section, and also functions as a filter to ensure that foreign substances 111 are trapped therein. As a specific example of the bypass pit 104, for example, the length L2 of the ink reservoir side 107 is set at 40 μm; the length L1 of the sub-reservoir side 106 at 40 μm; and the length L3 of the projected portion of the channel substrate 10 at 20 μm. As a minimum sectional portion, the width W is set at 50 μm and the height H1 at 20 μm to form a rectangle. The shape of foreign substances flowing in are mostly fibrous and they collide with and trapped by the polyamide wall on the sub-reservoir side 106 of the bypass pit 104. Other kinds of large foreign substances and air bubbles are trapped by an opening on the ink reservoir side 107 and those which are passed through this portion are trapped by the minimum sectional portion under the projected portion of the channel substrate 110. Even when such foreign substances are trapped by part of the bypass pit 104, the sub-reservoir 106 will never suffer from the shortage of ink since ink is supplied from any other portion to the sub-reservoir 106.

The ink supplied to the sub-reservoir 106 is brought into the nozzle channel 105 via the ink flow channel 112. If large foreign substances or air bubbles are trapped in the ink flow channel, the fluid resistance increases to result in insufficient supply of ink to the nozzle. Inferior ink-jetting such as a reduction in dot size and mis-jetting is thus caused. According to the present invention, however, foreign substances and air bubbles are trapped by the bypass pit 104 and as for an individual nozzle, ink is supplied from the sub-reservoir 106 as a common liquid chamber. Consequently, even though a part of the bypass pit 104 is clogged with foreign substances, the supply of ink remains unaffected thereby. As shown in FIG. 14, the sub-reservoir 106 is a common slit which is trapezoidal in cross section. For example, the length L4 of the base is set at 120 μm and the height L5 at 70 μm to form the sub-reservoir 106. Like the specific example of the bypass pit 4 above, the polyamide layer 109 is about 20 μm in height, whereas the height of the sub-reservoir 106 may be about 70 μm or greater, whereby a sufficient quantity of ink can be stored therein. Therefore, ink can be supplied to the nozzle channel at low channel resistance in comparison with the communicating channel or the common slit conventionally provided in the polyamide layer. The operating frequency is thus improved.

Figure 15:
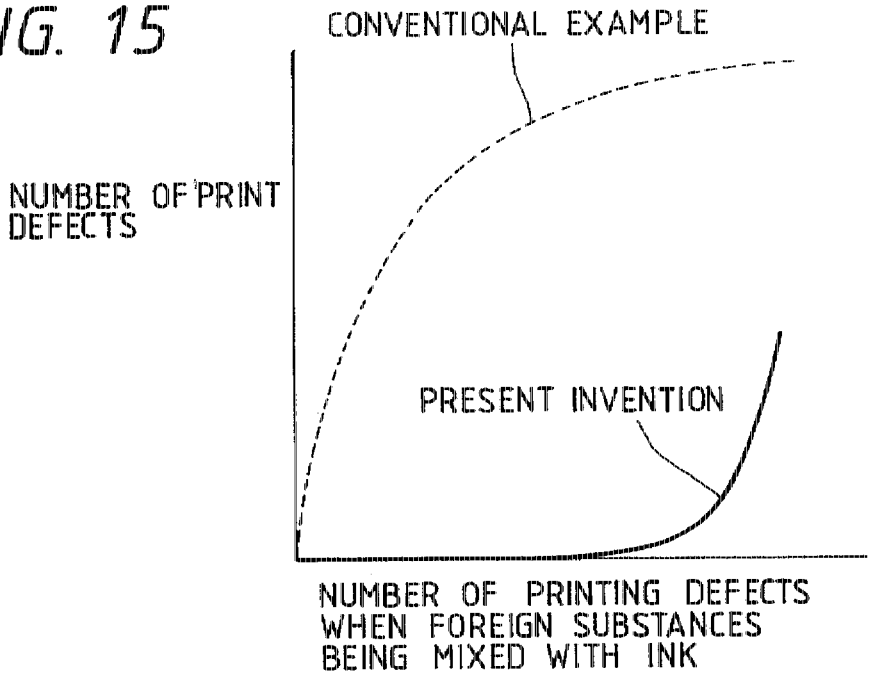
FIG. 15 is a graph showing the number of printing defects when foreign substances are allowed to be mixed with ink.

FIG. 15 is a graph showing the number of printing defects when foreign substances are allowed to be mixed with ink. As a conventional example, used is a conventional head having no sub-reservoir, which supplies ink to the nozzle channel using only an individual bypass pit. As is apparent from FIG. 15, a comparison between the conventional head and what embodies the present invention reveals that the mixture of foreign substances has not brought about almost any defects. Since the ink supplied to the head is passed through a filter provided separately, a large quantity of foreign substances during the experiments is not actually mixed in the ink. In the case of the structure in the second embodiment of the present invention, moreover, even if a ink supplying channel which has been conventionally provided is not used, image quality is not badly affected by foreign substances, thereby improving sufficient resistance to foreign substances. In other words, it is feasible to decrease not only the number of parts but also production costs.

Figure 16:
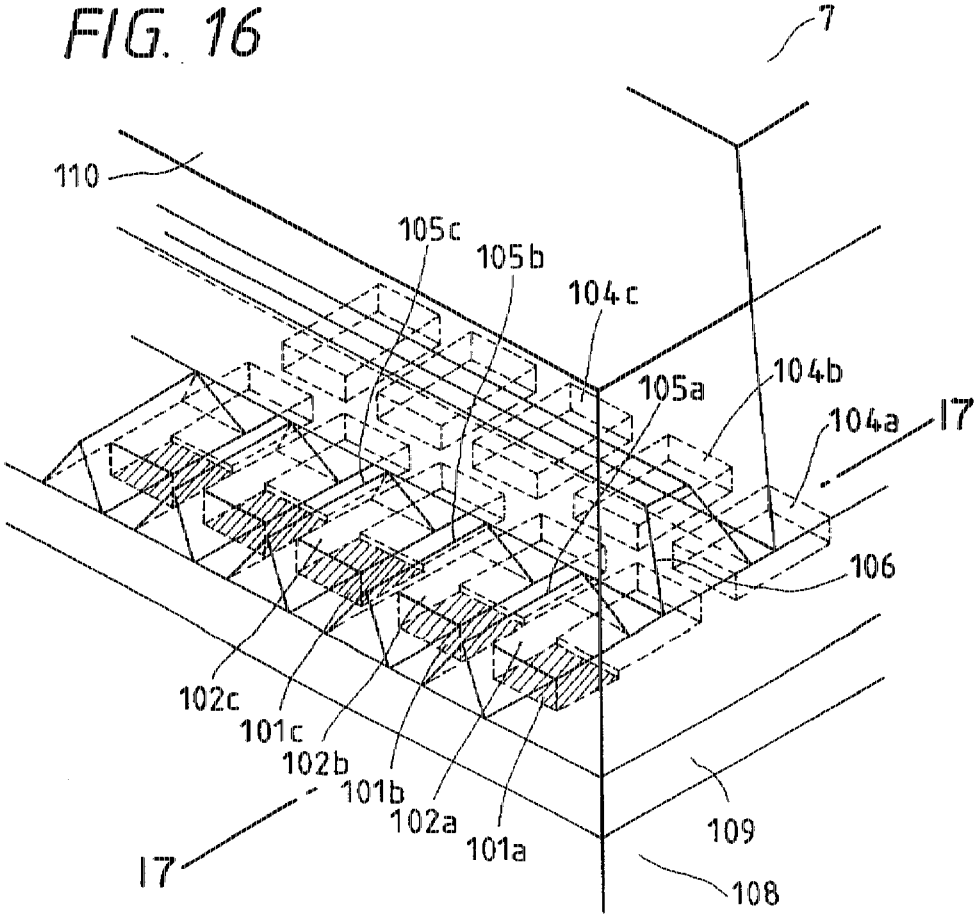
FIG. 16 is a schematic perspective view of a flow channel's structure of a thermal ink-jet head of a third embodiment of the present invention.
Figure 17:
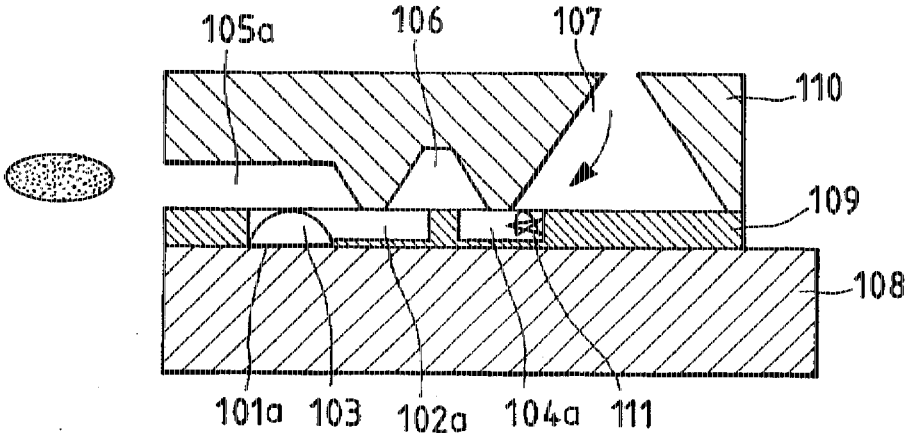
FIG. 17 is a sectional view showing the flow channel at the center of a nozzle in the thermal ink-jet head of the third embodiment.
Figure 18:
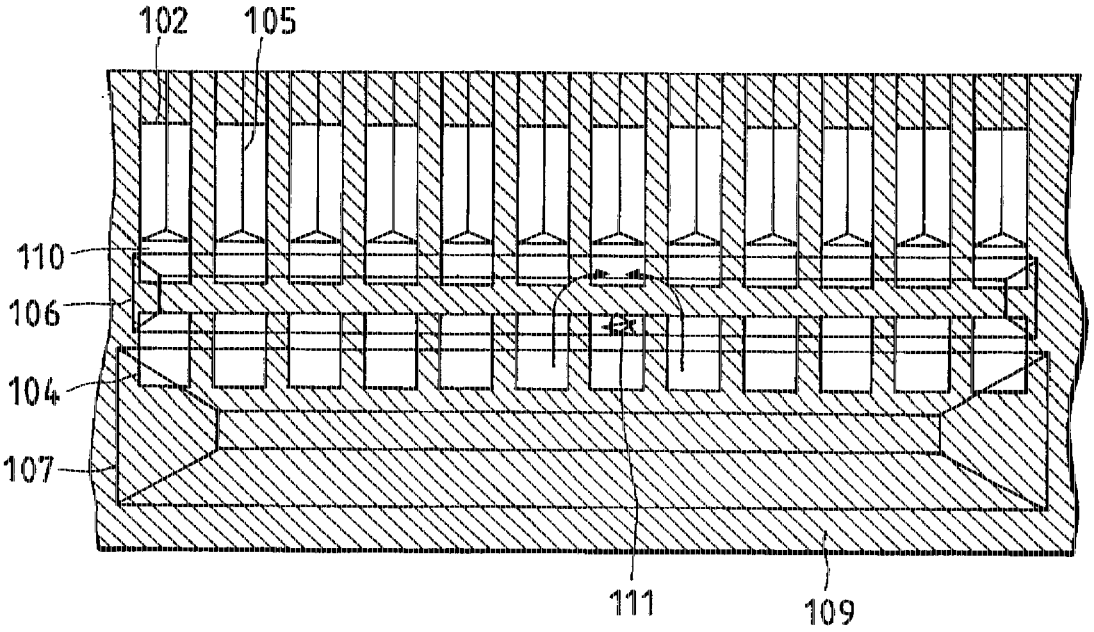
FIG. 18 is a plan view showing a structure of the flow channel in the thermal ink-jet head of the second embodiment.

FIG. 16 is a perspective view of a flow channel structure in a third embodiment of a thermal ink-jet head of the invention. FIG. 17 is a sectional view of a flow channel in the center of a nozzle. FIG. 18 is a top view of the flow channel structure. In these drawings, like reference characters designate like members of FIGS. 10 through 14 and the description thereof will be omitted. In the third embodiment of the present invention, the pit 102 and the ink flow channel 112 in the second embodiment thereof are coupled together to form an integral pit 102. With this arrangement, the whole channel length can be reduced to the extent of the wall of the polyamide layer used to separate the ink flow channel 112 from the pit 102 in the second embodiment of the present invention.

If the channel is long, the channel resistance increases and filling efficiency of ink lowers, thus causing the printing frequency to be also lowered. If, moreover, the channel is long, the length of the Si-device for use as a substrate increases. Consequently, the number of substrates obtainable from one Si-wafer is reduced and the cost of one nozzle device rises if the channel is long on the assumption that the yield ratio is the same. According to the third embodiment of the present invention, the channel resistance is lowered as the channel length can be decreased and the operating frequency is made improvable. Moreover, it is possible to offer inexpensive nozzle devices.

Even in the third embodiment of the present invention, the bypass pit 104 functions as a filter and when ink flows from the ink reservoir 107 via bypass pit 104 to the sub-reservoir 106, foreign substances in the ink are trapped by a part of the bypass pit 104. When the foreign substances are trapped by that part of the bypass pit 104, ink is supplied from the sub-reservoir 106 via the pit 102 onto the heating element 101 and the nozzle channel 105, so that image quality is prevented from deteriorating. Further, ink is supplied onto the heating element 101 simultaneously with the parallel movement of ink. Therefore, the flow channel resistance is lower than a case where ink is supplied via the nozzle channel 105 to the pit 102 as in the second embodiment of the present invention. Thus ink can be refilled at high speed and the operating frequency is also made improvable.

With the arrangement in the third embodiment of the present invention, the end of the nozzle channel 105 is located on the pit 102. When the whole channel is shortened, the end of the nozzle channel 105 may be located near the end portion of the heating element 101. As the nozzle channel 105 is formed by ODE, its end portion forms a tilted face. By locating the titled face close to the end portion of the heating element 101, the shape of the bubble produced on the heating element 101 is controlled. The bubble pressure is reflected from the tilted face and directed to the opening of the nozzle, so that the bubble pressure is effectively utilizable.

With the arrangement shown in the second and third embodiments of the present invention, the provision of the bypass pit 104 or 104 corresponds to each nozzle. However, the location of the bypass pit 104 or 104 is not limited to the example above and besides the number of bypass pits may be greater or smaller than that of nozzles. Since the bypass pit functions as a filter, even small foreign substances can be trapped by increasing the number of bypass pits. However, an increase in the number of bypass pits may result in increasing the flow channel resistance as the bypass pit 104 or 104 is also used as an ink flow channel. For this reason, these bypass pit 104 should be installed in an optimum range in consideration of the conditions stated above.

What is claimed is:

1. An ink-jet recording apparatus comprising:

a plurality of ink-jet portions, each ink-jet portion having a nozzle channel which has a jetting opening for jetting ink therefrom and an end portion remote from said jetting opening, a recess provided in said nozzle channel, a heat resistive element provided in said recess and an ink chamber located beneath said end portion to communicate with said recess, said ink chamber having a nonlinear surface;

a coupling means for coupling each ink chamber; and an ink reservoir communicating with said coupling means for providing ink to each ink chamber.

2. An ink-jet recording apparatus as claimed in claim 1 wherein said end portion in said nozzle has a non-perpendicular surface.

3. An ink-jet recording apparatus as claimed in claim 1, wherein said recess has a base larger than that of said heating resistive element and said heating resistive element is located opposite to said ink-jet portion.

4. An ink-jet recording apparatus as claimed in claim 1, wherein said end portion in said nozzle is provided in a position corresponding to said ink chamber.

5. An ink-jet recording apparatus comprising:

a heater substrate having a plurality of bubble generating resistive elements;

a channel substrate mounted over said heater substrate and having a plurality of nozzle channels, an ink reservoir, and an ink supplying opening, a sub-reservoir provided between and in communication with each of said nozzle channels of said channel substrate and said ink reservoir;

a synthetic resin layer provided on said heater substrate;

a plurality of first grooves on said layer for coupling each of said nozzle channels and said sub-reservoir, each of said first grooves corresponding at least to a nozzle channel formed on said channel substrate; and a plurality of second grooves on said layer for coupling said ink reservoir and sub-reservoir.

6. A ink-jet recording apparatus as claimed in claim 5, wherein said first grooves for coupling each of said nozzle channels and said sub-reservoir couples with a recess provided on said bubble generating resistive elements.

7. A thermal ink-jet head comprising:

a heater substrate having a plurality of bubble generating resistive elements;

a channel substrate mounted over said heater substrate and having a plurality of nozzle channels, and an ink reservoir, said nozzle channels each being formed in said channel substrate over a corresponding one of the bubble generating resistive elements and extending from an end portion of said corresponding bubble generating resistive element toward said reservoir;

a coupling flow channel in said channel substrate in communication with each of said nozzle channels, and providing flow communication between said plurality of nozzle channels and said ink reservoir, said coupling flow channel and said reservoir each extending along said channel substrate and having a wall therebetween; and a synthetic resin layer provided on said heater substrate, said synthetic resin layer having a plurality of a grooves formed therein for coupling said nozzle channels and said ink reservoir, each groove extending at least beneath a corresponding nozzle channel from said bubble generating element to a position where said groove is coupled to said coupling flow channel, wherein each of said grooves has a sectional area which is reduced along the direction of orientation of said corresponding nozzle channel in the distance from the bubble generating resistive element up to the flow channel, and each of said plurality of nozzle channels has a tilted surface, the area of which is expanded both in the direction of orientation of said nozzle channel and in a direction perpendicular to the direction of orientation of said nozzle channel.

8. An ink-jet recording apparatus as claimed in claim 7, wherein said ink reservoir has a portion whose width is partially narrowed.

9. A thermal ink-jet head as claimed in claim 7, wherein each of said nozzle channels extends along a corresponding bubble generating resistive element to a position where the nozzle channel is coupled with said flow channel and forms a face which is not perpendicular to the of orientation of said nozzle channel.

10. A thermal ink-jet head as claimed in claim 7, wherein the sectional area of each of said grooves increases along the length of said grooves from said bubble generating resistive element to said flow channel.

* * * * *

UNITED STATES PATENT AND TRADEMARK OFFICE

CERTIFICATE OF CORRECTION

PATENT NO. : 5,708,465
DATED : January 13, 1998
INVENTOR(S) : MORITA et al.

It is certified that error appears in the above-identified patent and that said Letters Patent is hereby corrected as shown below:

Claim 6, column 11, line 37, "A ink-jet" should read --An ink-jet--.

Claim 7, column 12, line 15, "of a grooves" should read --of grooves--.

Claim 9, column 12, line 37, "the of orientation" should read --the orientation--.

Signed and Sealed this

Fifteenth Day of June, 1999

*Attest:*

*Attesting Officer*

Q. TODD DICKINSON

*Acting Commissioner of Patents and Trademarks*